US006327730B1

(12) United States Patent
Corbett

(10) Patent No.: US 6,327,730 B1
(45) Date of Patent: Dec. 11, 2001

(54) ADJUSTABLE LIQUID TEMPERATURE CONTROL SYSTEM FOR A WASHING MACHINE

(75) Inventor: Mitchell N. Corbett, Clive, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/456,527

(22) Filed: Dec. 8, 1999

(51) Int. Cl.[7] ..... D06F 39/08; A47L 15/42

(52) U.S. Cl. ..... 8/158; 68/12.22; 68/207; 134/18; 134/58 D; 236/12.12

(58) Field of Search ..... 8/158; 68/12.19, 68/12.22, 207; 134/18, 56 D, 57 D, 58 D; 236/12.12

(56) References Cited

U.S. PATENT DOCUMENTS

| | | | |
|---|---|---|---|
| 4,147,297 | 4/1979 | Worst . | |
| 4,330,081 | 5/1982 | McMillan . | |
| 4,359,186 | 11/1982 | Kiendl . | |
| 4,406,401 | 9/1983 | Nettro . | |
| 4,455,701 | 6/1984 | Stehr et al. . | |
| 4,528,709 | 7/1985 | Getz et al. . | |
| 4,643,350 | 2/1987 | DeSchaaf et al. . | |
| 4,867,375 | 9/1989 | Ueki et al. . | |
| 4,931,938 | 6/1990 | Hass . | |
| 4,978,058 | 12/1990 | Duncan et al. . | |
| 5,032,992 | 7/1991 | Bergmann . | |
| 5,067,333 | 11/1991 | Duncan et al. . | |
| 5,231,722 | 8/1993 | Shacklock et al. . | |
| 5,255,844 | 10/1993 | Miller et al. . | |
| 5,439,019 | 8/1995 | Quandt et al. . | |
| 5,551,630 | 9/1996 | Enoki et al. . | |
| 5,975,124 * | 11/1999 | Stevens | 68/12.22 X |
| 5,978,995 * | 11/1999 | Bruntz et al. | 68/12.22 X |

FOREIGN PATENT DOCUMENTS

| | | | |
|---|---|---|---|
| 30 23 355 | 1/1982 | (DE) . | |
| 118 167 | 9/1984 | (EP) . | |
| 0185297 * | 8/1986 | (JP) | 68/12.19 |

* cited by examiner

*Primary Examiner*—Philip Coe
(74) *Attorney, Agent, or Firm*—Everett G.Diederiks, Jr.

(57) ABSTRACT

An adjustable liquid temperature control system for a washing machine regulates the temperature of washing liquid established in a washing tub in an accurate and economical manner without the use of a dedicated temperature sensor. Preferably, numerous default mixing ratios for hot and cold fill water are preset in the washing machine. The system is designed to enable the washing machine operator to adjust one or more of the default mixing ratios in order to selectively fine tune the system. In accordance with one embodiment, the operator can directly input a desired mixing ratio. In another embodiment, the operator can indirectly establish a mixing ratio by entering a desired washing temperature.

19 Claims, 2 Drawing Sheets

ADJUSTABLE LIQUID TEMPERATURE CONTROL SYSTEM FOR A WASHING MACHINE

BACKGROUND OF THE INVENTION

1. Field of the Invention

The present invention pertains to the art of washing machines, such as clothes washing or dish washing machines and, more particularly, to an automatic washing machine incorporating a system for controlling the temperature of washing liquid introduced into a tub or basket of the machine during an operating cycle.

2. Discussion of the Prior Art

Essentially every washing machine has some type of control to set the temperature of the fill water entering an associated washing machine tub. Typically, systems known in the art rely on controlling the amount of fill water supplied through hot and cold water valves to establish a desired temperature. More specifically the desired temperature in such a known system is established by opening one or both of the controlling hot and cold water valves. For instance, hot water would be supplied by opening the hot water valve and closing the cold water valve; warm water would be supplied with both valves open; and cold water would be supplied by opening the cold water valve while leaving the hot water valve closed. This basic type of system may not be considered satisfactory for many reasons, mainly due to the potential for varying temperatures and pressures of the incoming cold and hot water streams. Therefore, such a simple system can result in widely ranging temperatures of the fill water supplied to the washing tub between different washing operations.

Water temperature is an important factor in cleaning. For example, in a clothes washer, if the wash water temperature is too cold for a given operation, inadequate soil removal can result, while a wash temperature which is too hot can result in clothing damage, as well as a waste of energy. In fact, it has been noted that certain detergents work well within a relatively narrow temperature range such that fill water outside a desired temperature range can degrade the performance of a detergent.

In an attempt to address this problem, many proposals have been set forth. Mostly, these solutions involve providing complicated control systems to control the flow of fill water provided by the hot and cold water valves. Typically, these systems incorporate one or more temperature sensors which provide feedback signals used to more precisely control the water valves. However, these temperature sensors are both extremely costly and prone to failure such that these overall systems raise economic and reliability concerns.

For example, U.S. Pat. No. 4,528,709 proposes a washing machine temperature control system wherein the temperature and flow rate of hot and cold water inlets are separately sensed. The system calculates from this data the quantity of hot and cold water necessary to arrive at a desired overall temperature given a selected amount of water desired in the washing tub. Of course, such a system requires at least two thermistor type sensors and a flow meter or the equivalent in order to obtain the necessary data. As stated above, such sensors are both expensive and prone to failure.

U.S. Pat. No. 4,330,081 proposes a water temperature control system for a clothes washing machine that is designated to control a desired water temperature for use in the clothes washing tub. This system essentially obtains the desired temperature values by memorizing desired temperatures based on the type of clothes to be washed, such as cotton, wool, polyester, etc. Once again, in order to achieve the desired results, the temperature of the combined water flow must be sensed, such as through the use of a thermistor. In addition, in accordance with this patented arrangement, a multi-vibrator is coupled to input gates of a microprocessor. Once again, this solution suffers from the defect of employing thermistors which are both expensive and prone to failure, as well as a suspect multi-vibrator arrangement.

As a final example, U.S. Pat. No. 5,439,019 discloses a method and apparatus for filling a washing tub of an automatic clothes washer that is designed to actively regulate the temperature of the final volume of water present in the washing tub based on a preselected temperature inputted by an operator of the washing machine. Once again, this patent discloses the use of a thermistor to achieve the temperature control function. Specifically a thermistor is used to obtain a measurement which is representative of the water flowing through a mixing valve.

Based on the above, there exists a need in the art of automatic washing machines for an adjustable water control system which can accurately control the temperature of the fill water entering the washing tub while not requiring the use of expensive temperature sensors and their associated electronics.

SUMMARY OF THE INVENTION

A washing machine constructed in accordance with the present invention incorporates a system for controlling the temperature of washing liquid, most commonly water, supplied to a washing tub in an accurate and cost effective manner without the use of a built-in temperature sensor. This system provides for inputs from an operator of the desired temperature for the fill water, as well as the amount of fill water desired to be placed in the washing tub.

In accordance with the invention, the washing machine incorporates a fluid container or fill tub having an inlet for both hot and cold water. The hot water inlet includes a first valve to control the flow of water therethrough. Likewise, the cold water inlet also has an associated, second valve for controlling the amount of cold water which enters the fill tub. In one preferred embodiment of the invention, a control unit is provided to regulate the quantities of water supplied to the washing machine tub according to preset hot/cold water ratios. Preferably, there are actually five preset ratios, i.e., hot, hot/warm, warm, cold/warm and cold. More specifically, the hot ratio would be 100% hot water and no cold water, the hot/warm ratio would be 75% hot water and 25% cold water, the warm ratio would include a 50/50 mix of hot and cold water, the warm/cold ratio would include 25% hot water and 75% cold water, and finally the cold ratio would include 100% cold water. Provisions are made such that the ratios may be fine tuned by the operator, with the actual ratio of hot and cold water entering the washing tub being established based on the preference of the operator. In accordance with one embodiment, temperature vs. ratio information is made available to the operator in chart form to enable programming by the operator such that the hot and cold water valves are accordingly controlled. Once initial operator adjustments are made and stored, the operator would only have to select a desired washing operation which would be performed at the predefined temperature established by the preset ratio for that cycle.

In a second preferred embodiment of the invention, instead of having the user input desired ratios for the various amounts of hot and cold water supplied to the washing tub, the user would instead input the actual water temperature desired for a particular washing operation. The control system, in effect, incorporates a look-up table such that the controller would determine, based on the temperature inputted by the user, what ratios of hot and cold water should be set to establish the desired fill water temperature.

Additional objects, features and advantages of the present invention will become more readily apparent from the following detailed description of the preferred embodiments when taken in conjunction with the drawings wherein like reference numerals refer to corresponding parts in the several views.

DETAILED DESCRIPTION OF THE PREFERRED EMBODIMENTS

Figure 1:
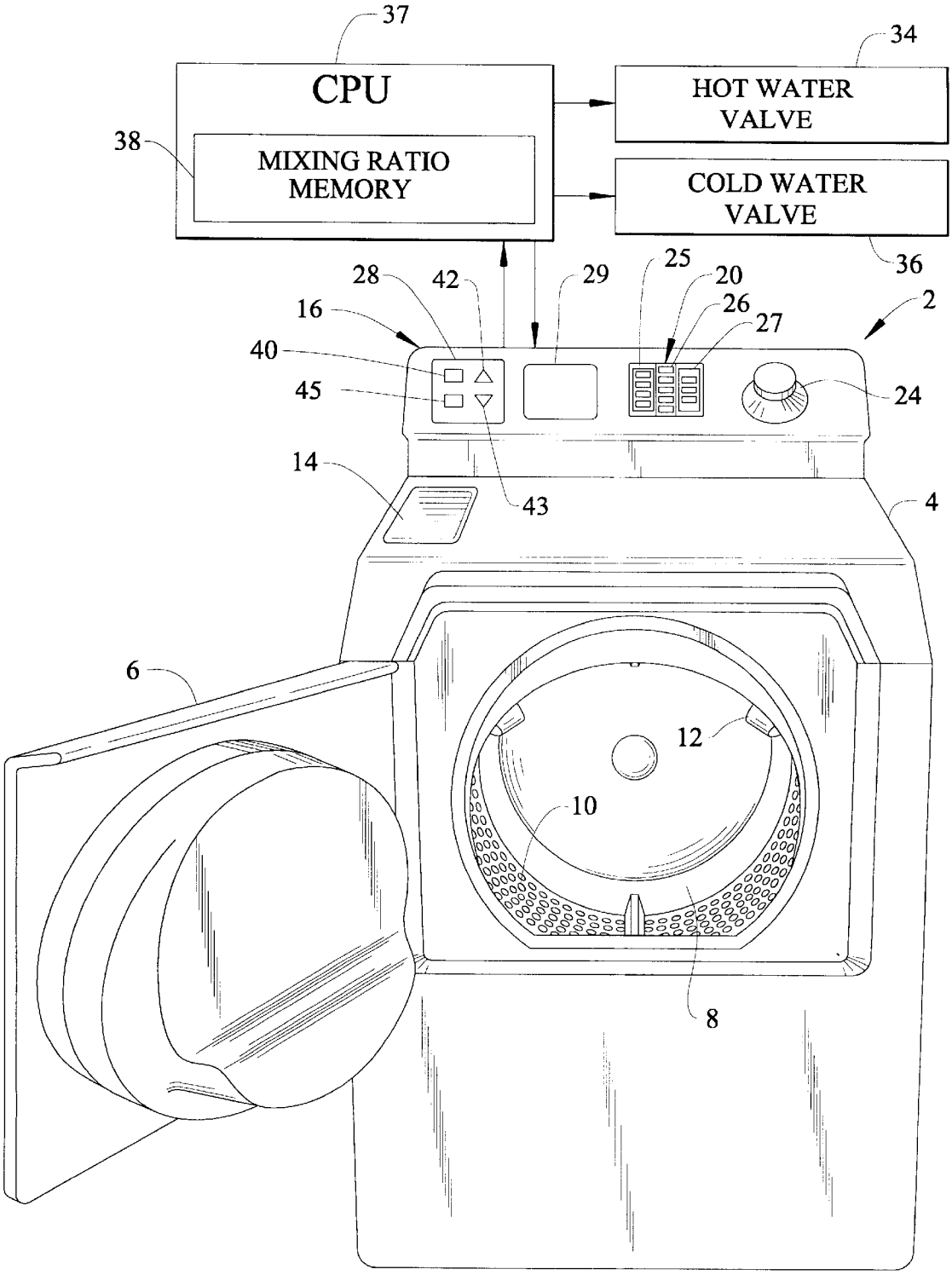
FIG. 1 is a front perspective view of a washing machine incorporating the adjustable water temperature control system according to the invention.
Figure 2:
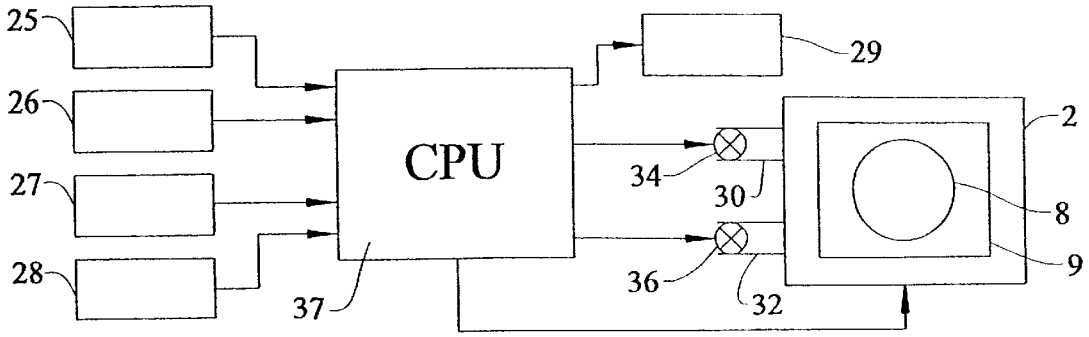
FIG. 2 is a diagrammatic drawing showing the arrangement of circuitry and valving associated with the invention.

For exemplary purposes, the invention will now be described for use in connection with a clothes washing machine generally shown at 2 in FIG. 1. However, it should be initially understood that the invention is applicable to various other types of appliances, including, but not limited to, dishwashers. As shown in FIG. 1, washing machine 2 includes an outer cabinet shell 4 having an associated door 6 which can be selectively opened to expose a washing basket 8. In the embodiment shown, washing basket 8 is mounted within outer cabinet shell 4 for rotation about an axis which is angled slightly downward and rearward. For the sake of completeness, washing basket 8 is shown to include a plurality of holes 10, as well as various annularly shaped and radially inwardly projecting fins or blades 12 which are fixedly secured to washing basket 8. In the manner known in the art, washing basket 8 is adapted to rotate during both wash and rinse cycles, such that articles of clothing placed therein actually tumble through either a water/detergent solution or water supplied within washing basket 8. Water for the selected operation is actually contained within an outer tub 9 as shown in FIG. 2. For the sake of completeness, washing machine 2 is also shown to include an upper cover 14 that provides access to an area for adding detergent, softener and the like.

More pertinent to the present invention, washing machine 2 is shown to incorporate an upper control panel 16. In the preferred embodiment shown, control panel 16 includes a keypad, generally indicated at 20, and a rotary control knob 24. Keypad 20 and control knob 24 are utilized to establish a desired washing operation, with keypad 20 and control knob 24 being used to manually set certain types of parameters of the washing machine 2. For instance, keypad 20 is shown to include a section 25 used to set a desired fill level based on a load size for a given washing operation, a section 26 for use in establishing desired wash and rinse temperatures, and a section 27 for establishing a desired washing operation, such as gentle, normal or the like cycles, typically based on the particular fabrics being washed. On the other hand, control knob 24 is used to set the type and duration of the washing operation. In accordance with the invention, further provided in keypad 20 is an operator input interface 28, along with a display 29, both of which will be described in detail below. Although the control panel 16 is shown to include keypad 20 and control knob 24, it should be understood that these particular types of control elements are merely intended to be exemplary and that other types of control elements, including manual switches and the like could be readily utilized.

Turning now to FIG. 2 there is shown a schematic block diagram of the adjustable liquid temperature control system constructed in accordance with the present invention. As shown, a hot water conduit 30 and a cold water conduit 32 are connected to washing machine 2 through a hot water valve 34 and a cold water valve 36, which respectively control the amount of hot and cold water to be supplied to washing machine 2. Valves 34 and 36 are, in turn, controlled by a central processing unit (CPU) or controller 37 according to an algorithm to be discussed in detail below.

In accordance with one preferred embodiment of the invention, CPU 37 is programmed at the factory to store in a memory 38 various preset or default mixing ratios of hot and cold water to washing machine tub 9. Preferably, five preset mixing ratios of hot to cold water are provided, although the actual number of ratios could readily vary in accordance with the invention. In this embodiment, washing machine 2 is provided with the following water settings: hot water, hot/warm water, warm water, warm/cold water and cold water. Accordingly, the five ratios are preset to the following default ratios: the hot ratio is established with 100% hot water and no cold water; the hot/warm ratio would be 75% hot water and 25% cold water; the warm ratio provides a 50/50 mix of hot and cold water; the warm/cold ratio includes 25% hot water and 75% cold water; and finally the cold ratio is constituted by 100% cold water. Obviously, the final temperature and amount of water supplied to washing machine 2 is based on both the amount of water from each of the hot and cold conduits 30 and 32 and the actual temperature of the water supplied in these conduits. Keep in mind of course that water is referenced here for exemplary purposes only, such that other temperature controlled liquids or solutions could be employed. For example, if the invention is utilized in connection with a laundromat having related pay cleaning operations, a water/detergent cleaning solution may be supplied to washing machine 2 at the desired temperature. In any event, different default ratios would simply be set at the factory.

With this arrangement, an operator of washing machine 2 can simply utilize the machine with the preset ratios, with the washing temperature being simply selected at section 26 of keypad 20. However, in accordance with the invention, the operation of machine 2 may be adjusted by having the operator alter, at interface 28, the preset ratios of hot to cold water which are stored in the memory of CPU 37. The ability to change the preset ratios can be extremely important due to the fact that the temperatures of the hot and cold water supplied to washing machine 2 can vary between different locations and consumers. That is, due to variations in the water pressure and temperature during the different seasons and geographical locations of individual washing machines 2, as well as the setting specifically accorded to a hot water heater in a household, the hot and cold temperatures of the water supplied to washing machine 2 may vary considerably. In order to compensate for this variation without requiring dedicated temperature sensors or thermistors, keypad 20 can be used to vary the water ratios as needed according to the specific hot and cold water temperatures in the user's house.

At this point, it should also be realized that a particular washing temperature may be needed to provide the most potentially effective washing performance. For example, assume that a particular washing machine 2 has an associated inlet hot water temperature of 180° F. and a cold water supply at 50° F., but a wash temperature of 130° F. is needed based on the chemical detergents that are used, the types of clothes to be washed and the particular washing operation to be performed. By using the preset hot-warm ratio, a temperature in the order of 147° F. would be established. With the warm ratio setting, a temperature of 115° F. would be provided. Either of these temperature settings may not achieve optimal performance of the appliance. By permitting the operator to adjust the preset ratios stored in a register of CPU 37 in accordance with the present invention as detailed below, the user can achieve the 130° F. temperature within washing basket 8.

Figure 3:
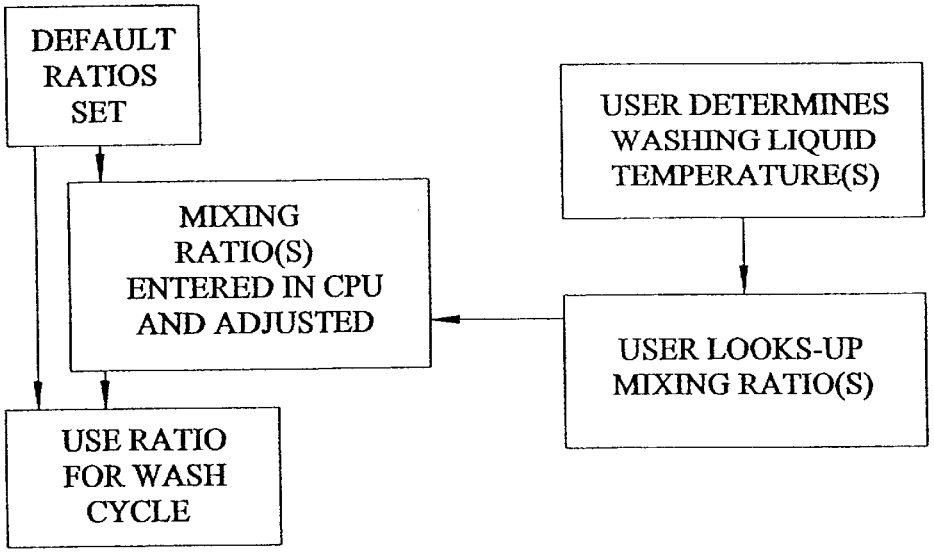
FIG. 3 is a general flow chart illustrating the use of the adjustable water temperature control system according to a first preferred embodiment of the invention.

In accordance with this preferred embodiment, the operator can adjust the ratios through interface 28. More particularly, interface 28 includes a program or setup button 40, raise and lower buttons 42 and 43, and a cancel button 45. During initial setup as illustrated in the flow chart of FIG. 3, a user would first measure the actual temperature of the water coming from the inlet conduits 30 and 32. For convenience, a chart is preferably provided which would allow the operator to look up what suggested ratios should be entered into CPU 37 based on the actual temperature of the hot and cold water supplied to the washing machine 2. Of course, the operator will also have the option of selecting personally preferred ratios. Once the desired ratio settings are known, the initial pressing of program button 40 will result in the operator being sequentially prompted through display 29 to enter the desired ratios using raise and lower buttons 42 and 43. After all the desired ratios are set in this manner, the washing machine 2 can be operated normally through sections 25–27 of keypad 20 in a substantially conventional manner. During use, display 29 preferably provides an indication of the selected options for a particular washing operation.

Figure 4:
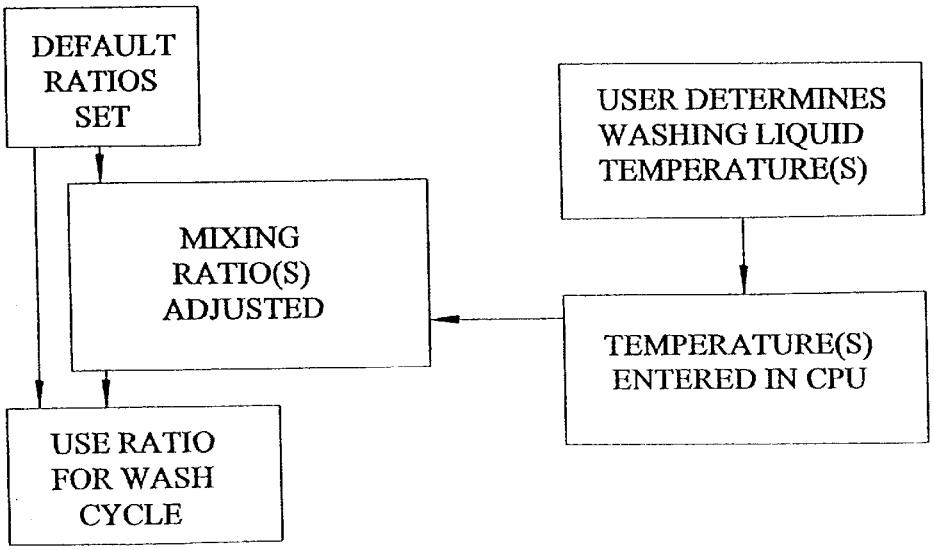
FIG. 4 is a general flow chart illustrating the use of the adjustable water control system according to a second preferred embodiment of the invention.

In accordance with a second preferred embodiment of the invention, instead of entering desired hot/cold water ratios through interface 28, the operator can directly enter the hot and cold temperatures for the supply water. That is, for initial setup, depressing program button 40 will result in the user being prompted to enter the inlet water temperatures instead of the water ratios. Therefore, CPU 37 automatically establishes the hot and cold water ratios based on the inputted temperatures in accordance with a preset program algorithm or table. The setup and use of washing machine 2 in accordance with this embodiment is generally represented in the flow chart of FIG. 4. With this embodiment, the need for a user to carry any type of chart or calculate any of the ratios to be entered into control unit 26 via keypad 20 would be obviated.

Although described with reference to preferred embodiments of the invention, it should be readily apparent that various changes and/or modifications can be made to the invention without departing from the spirit thereof. For example, instead of the five preferred ratios discussed above, adjustable sets of ratios could be stored. For example, one set for summer and another for winter to compensate for temperature variations in the incoming water supply. In addition, as mentioned above, this invention could be applied to numerous different types of machines. For instance, washing machine 2 need not constitute a clothes washer, but could be a dishwasher or commercial dry cleaning equipment. Therefore, it should be understood that the preferred embodiments described are intended to be illustrative and not restrictive, and the invention is only intended to be limited by the scope of the following claims.

I claim:

1. In a washing machine including a tub into which a first, high temperature liquid and a second, low temperature liquid are directed to flow for performing a washing operation, an adjustable liquid temperature control system comprising:

a first valve through which the high temperature liquid is supplied to the tub;

a second valve through which the low temperature liquid is supplied to the tub; and a controller for regulating a quantity of each of said high and low temperature liquids supplied to the tub through the first and second valves according to one of multiple mixing ratios, said controller being selectively programmable by an operator of said washing machine to adjust at least one of said multiple mixing ratios.

2. The adjustable liquid temperature control system according to claim 1, wherein said at least one of said multiple mixing ratios is selectively adjustable by the operator to provide any percentage between 0% to 100% of the high temperature liquid.

3. The adjustable liquid temperature control system according to claim 2, wherein said at least one of said multiple mixing is selectively adjustable by the operator to provide any percentage between 0% to 100% of the low temperature liquid.

4. The adjustable liquid temperature control system according to claim 3, wherein said multiple mixing ratios are preset in said washing machine to include:

a) a hot ratio established by 100% of the high temperature liquid and 0% of the low temperature liquid;

b) a hot/warm ratio established by 75% of the high temperature liquid and 25% of the low temperature liquid;

c) a warm ratio established by 50% of the high temperature liquid and 50% of the low temperature liquid;

d) a warm/cold ratio established by 25% of the high temperature liquid and 75% of the low temperature liquid; and e) a cold ratio established by 0% of the high temperature liquid and 100% of the low temperature liquid.

5. The adjustable liquid temperature control system according to claim 1, further comprising: a control panel having a plurality of control elements for use in programming the controller.

6. The adjustable liquid temperature control system according to claim 5, further comprising: means for enabling direct entry of the at least one of said multiple mixing ratios by an operator through the control elements of said control panel.

7. The adjustable liquid temperature control system according to claim 5, further comprising: means for indirectly adjusting the at least one of said multiple mixing ratios by an operator through the control elements of said control panel.

8. The adjustable liquid temperature control system according to claim 7, wherein said means for indirectly adjusting enables a desired washing liquid temperature to be entered through said control panel.

9. In a washing machine including a tub into which a first, high temperature liquid and a second, low temperature liquid are directed to flow for performing a washing operation, an adjustable liquid temperature control system comprising:

means for storing a plurality of preset supply ratios of the high and low temperature liquids;

means for selecting one of said plurality of supply ratios in order to determine a quantity of each of said high and low temperature liquids to be delivered into the tub for the washing operation; and means for enabling an operator of the washing machine to selectively alter at least one of the plurality of supply ratios.

10. The adjustable liquid temperature control system according to claim 9, wherein said enabling means includes a control panel having a plurality of control elements for use in programming the at least one of the plurality of supply ratios.

11. The adjustable liquid temperature control system according to claim 10, wherein said enabling means provides for direct entry of the at least one of the plurality of supply ratios through the control elements of the control panel.

12. The adjustable liquid temperature control system according to claim 10, wherein said enabling means provides for indirect adjusting of the at least of the plurality of supply ratios through the control elements of the control panel.

13. The adjustable liquid temperature control system according to claim 12, wherein said enabling means provides for a desired washing liquid temperature to be directly programmed by the operator.

14. The adjustable liquid temperature control system according to claim 9, wherein said enabling means permits the at least of the plurality of supply ratios to provide any percentage between 0% to 100% of the high temperature liquid.

15. The adjustable liquid temperature control system according to claim 14, wherein said enabling means permits the at least of the plurality of supply ratios to provide any percentage between 0% to 100% of the low temperature liquid.

16. The adjustable liquid temperature control system according to claim 15, wherein said plurality of supply ratios are preset in said washing machine to include:

a) a hot ratio established by 100% of the high temperature liquid and 0% of the low temperature liquid;

b) a hot/warm ratio established by 75% of the high temperature liquid and 25% of the low temperature liquid;

c) a warm ratio established by 50% of the high temperature liquid and 50% of the low temperature liquid;

d) a warm/cold ratio established by 25% of the high temperature liquid and 75% of the low temperature liquid; and e) a cold ratio established by 0% of the high temperature liquid and 100% of the low temperature liquid.

17. A method of controlling a temperature of a quantity of washing liquid introduced into a tub of a washing machine for a washing operation comprising:

regulating a ratio of a first, high temperature liquid to a second, low temperature liquid delivered to the tub according to a selected one of a plurality of wash settings selected by an operator of the washing machine in order to attain a desired washing temperature; and altering, through re-programming by the operator, the ratio of the first and second liquids for at least one of the plurality of wash settings in order to selectively adjust the desired washing temperature.

18. The method according to claim 17, further comprising:

presetting a plurality of default ratios for the first and second liquids in the washing machine; and replacing one of the default ratios stored in the washing machine upon re-programming by the operator.

19. The method according to claim 18, wherein the plurality of default mixing ratios are preset to include:

a) a hot ratio established by 100% of the high temperature liquid and 0% of the low temperature liquid;

b) a hot/warm ratio established by 75% of the high temperature liquid and 25% of the low temperature liquid;

c) a warm ratio established by 50% of the high temperature liquid and 50% of the low temperature liquid;

d) a warm/cold ratio established by 25% of the high temperature liquid and 75% of the low temperature liquid; and e) a cold ratio established by 0% of the high temperature liquid and 100% of the low temperature liquid.

* * * * *